US010533283B2

(12) United States Patent
Parker et al.

(10) Patent No.: US 10,533,283 B2
(45) Date of Patent: Jan. 14, 2020

(54) REDUCED DIAMETER FORAMINOUS EXHAUST CYLINDER

(71) Applicant: Valmet, Inc., Biddeford, ME (US)

(72) Inventors: Richard Alan Parker, Cape Elizabeth, ME (US); Laurent R. Parent, Westbrook, ME (US); Saravanan Marimuthu, Saco, ME (US)

(73) Assignee: Valmet, Inc., Biddeford, ME (US)

( * ) Notice: Subject to any disclaimer, the term of this patent is extended or adjusted under 35 U.S.C. 154(b) by 209 days.

(21) Appl. No.: 15/652,359

(22) Filed: Jul. 18, 2017

(65) Prior Publication Data

US 2019/0024313 A1 Jan. 24, 2019

(51) Int. Cl.

| | |
|---|---|
| ***F26B 3/06*** | (2006.01) |
| ***D21F 5/02*** | (2006.01) |
| ***F26B 13/16*** | (2006.01) |

(52) U.S. Cl.

CPC ..... *D21F 5/02* (2013.01); *F26B 3/06* (2013.01); *F26B 13/16* (2013.01)

(58) Field of Classification Search

CPC .. F27B 9/28; F26B 13/10; F26B 13/18; F26B 13/183; F26B 3/04; F26B 3/06; D21F 3/0281; D21F 1/46; B21B 27/10

See application file for complete search history.

(56) References Cited

U.S. PATENT DOCUMENTS 3,259,961 A 7/1966 Bryand
3,590,453 A * 7/1971 Bryand ..... B01D 33/067 492/32
4,050,131 A 9/1977 Bryand
4,198,761 A * 4/1980 Minerbe ..... F26B 3/06 34/364
4,364,185 A * 12/1982 Dussourd ..... F26B 13/16 34/115
4,693,015 A * 9/1987 Hemsath ..... F26B 13/186 34/119
5,371,954 A 12/1994 Pinter et al.
6,079,116 A * 6/2000 Jewitt ..... D21F 5/182 34/115
6,306,258 B1 * 10/2001 Lange ..... D21F 1/48 162/290
6,314,659 B1 11/2001 Parker
6,923,926 B2 * 8/2005 Walter ..... A61F 13/1565 156/200
7,040,038 B1 * 5/2006 Beaumont ..... D21F 5/182 162/204
8,656,605 B2 * 2/2014 Parker ..... F26B 13/16 34/629
8,919,008 B2 * 12/2014 Baubock ..... D21F 5/021 34/119
9,428,861 B2 * 8/2016 Consolato ..... D21F 5/021
9,670,617 B2 * 6/2017 Chou ..... B65H 20/02
(Continued)

*Primary Examiner* — Gregory A Wilson

(74) *Attorney, Agent, or Firm* — Pierce Atwood LLP; Kevin M. Farrell

(57) ABSTRACT

Described herein are devices and methods for the drying of permeable and semi-permeable webs such as paper products in a physical environment with limited space while providing for higher flow rates. The devices and methods of the present invention are for use with rotating, foraminous shelled roll dryers and are implemented by redesigning the aspects of the devices and methods associated with exhausting spent drying gas.

14 Claims, 13 Drawing Sheets

(56) References Cited

U.S. PATENT DOCUMENTS

| | | | | |
|---|---|---|---|---|
| 2014/0150280 | A1* | 6/2014 | Goral | F26B 13/183<br>34/110 |
| 2015/0068372 | A1 | 3/2015 | Abney et al. | |
| 2018/0080712 | A1* | 3/2018 | Ayrault | D21F 5/184 |
| 2018/0313607 | A1* | 11/2018 | Bohn | F26B 3/06 |

* cited by examiner

REDUCED DIAMETER FORAMINOUS EXHAUST CYLINDER

BACKGROUND

Traditional axial exhaust used on through-air dryers and bonders (i.e., prior art shelled roll dryers and bonders), such as those used in the paper manufacturing industry, has flow limitations based on the available open area in the end plane of the dryer cylinder head as controlled by the head open area to meet structural demands. The traditional axial exhaust also has limitations with regard to non-uniform air flow, high energy usage and space impact. These limitations can impinge on the uniformity of drying, result in higher energy costs and impact space usage in a facility.

During a drying or thermal bonding process, heated air (heated process air) passes through a wet web traveling on the rotating cylinder (the dryer cylinder or foraminous shelled cylinder). The heated process air travels through the web and between the shell openings. Typically, moisture in the web or the web itself cools the heated air so that the temperature inside the shell is cooler than that of the heated air applied to the web. This cooler but still hot air travels radially through the foraminous shell and then axially through the exhaust. During the drying process, the heated air typically ranges from about 120 to about 290 degrees Celsius and cools to about 80 to about 260 degrees Celsius after passing through the traveling web and picking up moisture.

The exhaust, referred to herein as the "exhaust head" with respect to prior art devices, in a prior art through-air dryer or bonder typically has a tapered shape, the taper becoming narrower the further from the dryer end plane. See, for example, part no. 210 of FIG. 1A of U.S. Pat. No. 8,656,605 to Parker for an illustration of the prior art exhaust head. This shape results in increasing air (gas) velocities as the exhaust narrows to the axial exit. This variation in air flow velocity is problematic at high air flows as it results in non-uniform air flow across the web with non-uniform velocities found at the edges of the web being dried or bonded. This results in non-uniformity in product drying and properties. Further, this limitation often forces the dryer design to be a double end exhaust to allow for sufficient airflow volume to meet the production requirements. A double ended exhaust requires having exhaust air exiting on the tend side (i.e., the operator side) of the dryer. This hinders fabric changes and access to the tend side of the dryer. Even when double end axial exhaust is used, the limiting factor for increased air flow above normal limits is the head open area. Thus, inherent to the design of the prior art exhaust heads is the resulting high velocities. The high velocities create pressure losses. High energy usage is required to overcome this pressure loss and total air flow volume.

The exhaust head design in prior art dryers also creates limitations with regard to space requirements by, for example, limiting options with regard to placement of exhaust ducting. Versatility with regard to placement of exhaust ducting will allow for a greater range of install options for paper manufacturers.

In prior art dryers, the head could be redesigned to achieve lower exhaust duct (head radial) velocities by, however, it's impractical, costly and time consuming to design new heads for each design scenario. Further, a linear (same diameter as dryer roll) exhaust would adversely affect drying at the edge of the web by bleeding drying gas from the edge of the web.

A solution that allows greater air flow capacity with greater uniformity of airflow while taking into account space limitations inherent in the prior art design will result in greater uniformity in drying while increasing the production capacity of the dryer or thermal bonder with lower energy costs and better space utilization over prior art designs.

SUMMARY OF THE INVENTION

The present invention relates to through-air dryers (foraminous shelled roll dryers) and bonders comprising a rotating, foraminous shelled cylinder for drying wet permeable and semi-permeable, woven and non-woven webs. During the drying process, heated process air passes through a wet web traveling on the rotating foraminous cylinder. The heated process air travels through the web and between the shell openings. Typically, these dryers and bonders are large and expensive apparatuses. In the present application, the term "dryer" is considered to also incorporate the term "bonder," unless specifically indicated otherwise.

The present invention comprises a reduced radial diameter foraminous exhaust cylinder. This replaces the tapered exhaust head design of prior art dryers/bonders. By design, the reduced diameter radial exhaust cylinder allows for the adaptation/installation of the apparatus into areas of varying geometries and space constraints, allows for higher overall flow rates (volume) while maintaining lower exhaust velocities, more uniform drying of the web and lower energy costs. Further, for many applications this will result in a single exhaust rather than double exhaust. In other applications, a double end radial exhaust configuration will allow higher flow rates, hence greater production than the current state of the art, with greater flexibility with regard to installation space. Since the exhaust portion of the dryer or bonder of the present invention is a reduced diameter as compared to the shelled roll dryer, the exhaust apparatus and exhaust duct work is smaller in size which is a benefit due to space constraints frequently encountered by users. Thus, less room is needed in the installation location and greater options are available with regard to exhaust apparatus location and duct work routing.

The reduced diameter exhaust cylinder has a diameter and length to accommodate the design air flow of the particular application and is a function of the active drying area (A1) and drying capacity per unit area. The accommodation will result in exhaust areas (A2) typically between 30-50% of the active drying area. Unlike prior art dryer exhaust, the exhaust can be <360° around the exhaust cylinder circumference. The exhaust area can be adjusted with either the length of the cylinder exhaust portion or the diameter. The ratio will be determined by finding the optimum balance between axial velocity at the step plane entering the exhaust cylinder and the available space for the external exhaust duct which mates to the exhaust cylinder. One of ordinary skill in the art, with knowledge of the teachings of this specification, will be able to determine optimal sizing and configuration of the reduced diameter exhaust of the present invention.

As indicated above, A1=circumference of larger diameter×(hood wrap angle/360°)×large diameter cylinder length. A2=circumference of reduced diameter×(exhaust duct wrap angle/360°)×reduced diameter length.

Flexibility in the design of the exhaust cylinder allows for lower velocity, higher capacity exhaust. This allows for energy savings since a higher exhaust velocity, as is inherent with prior art designs, results in higher energy usage and cost. Further still, and unlike prior art exhaust ducting, the exhaust ducting of the present invention can be shaped to give uniform or substantially uniform velocities around the duct and, by extension, through the web being dried or bonded. One of ordinary skill in the art, armed with the teachings of the present invention, would have the knowledge to design exhaust shapes (i.e. length×diameter) to give the desired uniform velocity.

Therefore, the reduced diameter exhaust cylinder of the present invention results in a reduced pressure drop across the dryer, greater exhaust volume or capacity, reduced exhaust velocity, greater uniformity of air flow and drying, less energy consumption and greater space flexibility.

In another embodiment, the exhaust cylinder of the present invention may be made in a larger diameter than the shelled drying cylinder if space confines, for example, demanded or allowed for such a design.

The dryer technology of the present invention may also be used for thermal bonding. Thermal bonding sometimes uses a cool zone in the thermal bonding process. The reduced diameter exhaust cylinder of the present invention allows for selective exiting of "cool zone" air. The design of the prior art exhaust head would result in the mixing of cool and hot air since the separate exit of cool air is not possible with the prior art exhaust head. This requires greater energy requirements as the cool air reduces the temperature of the heated exhaust air. The reduced diameter exhaust cylinder of the present invention allows for the exhaust of the cool air without mixing with heated air.

Thus, in an embodiment of the present invention, it is contemplated that the through-air dryer (foraminous shelled roll dryer) of the present invention comprises a foraminous shell cylinder with an exhaust cylinder having a reduced diameter as compared to the foraminous shelled cylinder over which a permeable or semi-permeable web is dried. The exhaust cylinder is positioned axial to the foraminous shelled cylinder, its diameter and length being determined by the size of the foraminous shelled cylinder, needed air capacity and space limitations of the installation site, as detailed below in the Detail Description.

In one aspect of the present invention, a device is contemplated for drying permeable and semi-permeable woven and non-woven webs (i.e. the foraminous shelled roll dryer or "dryer"). The foraminous shelled roll dryer comprises a first rotatable, foraminous shelled cylinder. The foraminous shelled cylinder comprises a first and a second spaced apart, circular, parallel or essentially parallel end members (i.e., the roll heads), each having a diameter and an inner face and an outer face. A foraminous cylinder is positioned between and secured to the first and second parallel end members, the foraminous cylinder (the first foraminous cylinder) having an outer diameter substantially equivalent to the diameter of the parallel end members and having a surface area. The dryer is designed for a flow of drying gas into the first foraminous cylinder.

The dryer of the present invention also comprises a second foraminous cylinder of a smaller diameter (i.e., the exhaust cylinder) than the first foraminous cylinder positioned at the outer face of one of the parallel end members and in fluid communication with the first foraminous cylinder, having a surface area of about 20% to about 75% of the surface area of the first foraminous cylinder, the second foraminous cylinder designed for exhausting drying gas out of the first foraminous cylinder.

In another aspect of the present invention, the surface area of the second foraminous cylinder is about 40% to about 60% or about 30% to about 50% the surface area of the first foraminous cylinder. In a further aspect of the present invention, the diameter of the second foraminous shell is at least 10% less than the diameter of the first foraminous cylinder or at least 25% less than the diameter of the first foraminous cylinder. In yet another aspect of the present invention, the diameter of the second foraminous shell is at least 10% less but no more than 40% less than the diameter of the first foraminous cylinder.

In another aspect of the present invention, the second foraminous cylinder has a circular parallel end member positioned at the end of the second foraminous cylinder positioned opposite to the first parallel end member and parallel or essentially parallel to the first parallel end member.

In yet another aspect of the dryer of the present invention, the dryer comprises a third foraminous cylinder (i.e., a second exhaust cylinder) of a smaller diameter than the first foraminous cylinder positioned at the outer face of the second parallel end member and in fluid communication with the first foraminous cylinder. The combined surface areas of the second and third foraminous cylinders are about 20% to about 75% of the surface area of the first foraminous cylinder. As with the second foraminous cylinder, the third foraminous cylinder is designed for exhausting drying gas out of the first foraminous cylinder. The second and third foraminous cylinders are typically of substantially equal size and dimensions but need not be. The second and third foraminous cylinders typically have substantially equal flow capacities but need not.

In a further aspect of the dryer of the present invention, the combined surface area of the second and third foraminous cylinders is about 40% to about 60% or about 30% to about 50% the surface area of the first foraminous cylinder. In a further aspect of the present invention, the diameter of the third foraminous shell is at least 10% less than the diameter of the first foraminous cylinder at least 25% less than the diameter of the first foraminous cylinder.

In a further aspect of the dryer of the present invention, the third foraminous cylinder has a circular parallel end member positioned the end of the third foraminous cylinder positioned opposite to the second parallel member and parallel to the second parallel member. In yet a further aspect of the dryer of the present invention, the diameter of the third foraminous shell is at least 10% less but no more than 40% less than the diameter of the first foraminous cylinder.

In a further aspect of the dryer or bonder of the present invention, dryer or bonder may further comprise an area, a "cool zone," substantially the length of the first foraminous cylinder designed for the delivery of cooling gas separately from the delivery of the drying gas, wherein said area designed for the delivery of a cooling gas is located at or proximal to where the web being dried leaves the first foraminous cylinder. The cooling gas may be at least 100° C. lower than the temperature of the drying gas. The temperature of the cooling gas is approximately 4° C. to approximately 32° C. but can be cooler or hotter so long as it is effective in cooling the web as it exits the drying or bonding cylinder. The temperature of the cooling gas may be ambient temperature.

In yet a further aspect of the dryer of the present invention, the second foraminous cylinder further may comprise an area substantially the length of the second foraminous cylinder or less than the length of the second foraminous cylinder designed for the exhausting of cooling gas separately from the exhausting of the drying gas.

In yet a further aspect of the dryer of the present invention, the third foraminous cylinder, if present, further may comprise an area substantially the length of the third foraminous cylinder or less than the length of the third foraminous cylinder designed for the exhausting of cooling gas separately from the exhausting of the drying gas.

In yet another embodiment, methods of use of the drier/bonder of the present invention are evident from the description herein and are specifically included as part of the disclosed invention.

DETAILED DESCRIPTION OF THE INVENTION

Figure 1:
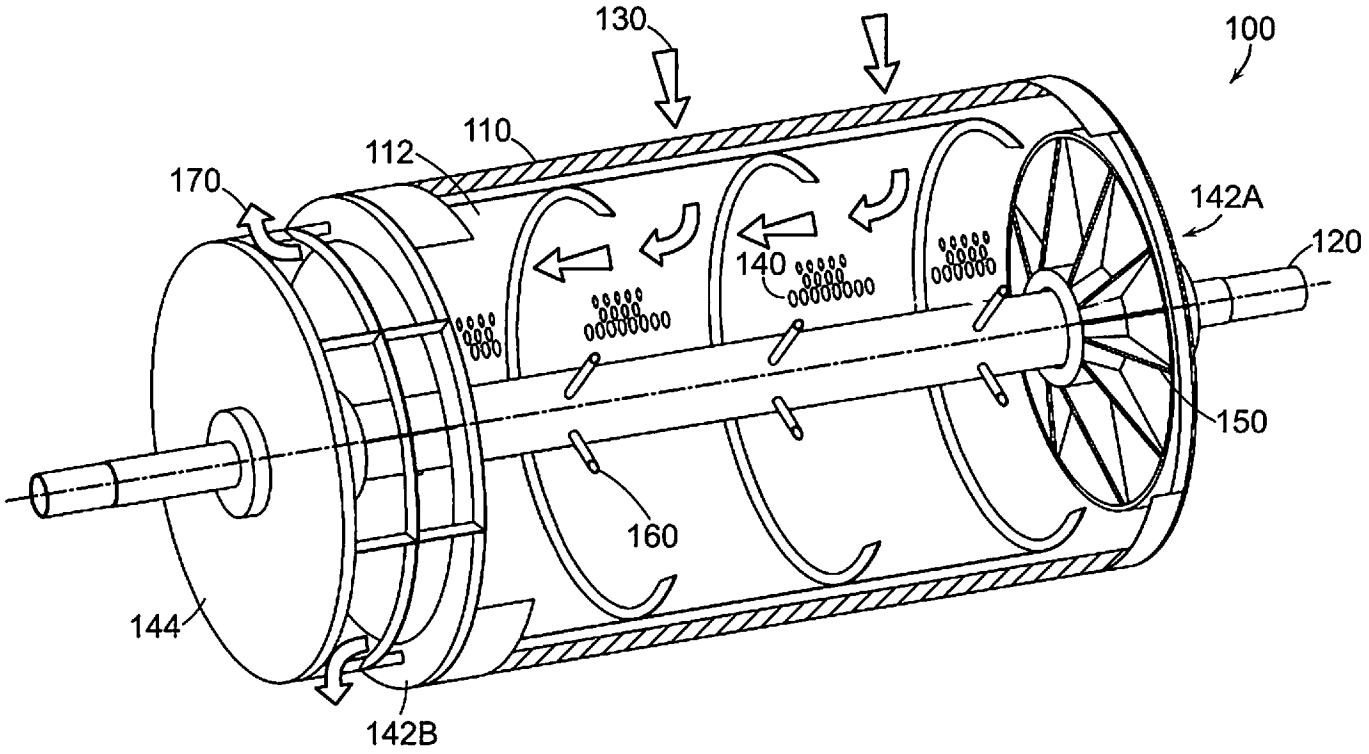
FIG. 1 shows a perspective view of the foraminous shelled roll dryer of the present invention with reduced diameter exhaust.

The present invention is directed towards apparatuses for and methods of drying permeable and semi-permeable webs such as paper, paper products and other nonwoven fiber products such as, but not limited to, filter media, hygiene products and wipes. U.S. Pat. Nos. 3,259,961, 3,590,453, 4,050,131, 6,314,659 and 8,656,605 describe devices and methods of drying permeable and semi-permeable webs, and are incorporated herein by reference in their entirety. The web may be comprised of woven and/or non-woven fibers. The present invention improves on devices and methods of drying permeable and semi-permeable webs by reconfiguring the device to allow for economical use of space in the drying facility and better control of exhaust gas resulting in greater control of velocity of drying gas across the web, thereby, resulting in greater drying uniformity while lowering energy requirements. Further, the foraminous shelled roll dryer design of the present invention may reduce or eliminate the need for baffles or other partitions in the first foraminous cylinder of the dryer resulting in cost savings in the manufacture of the dryer. In this regard, in an embodiment of the present invention, the device and methods of the present invention relate to the novel and non-obvious design of the exhaust section of the dryer and uses thereof. By reconfiguring the exhaust section of the dryer, the reduced diameter radial exhaust cylinder allows for the adaptation of the apparatus into areas of varying geometries and space constraints, allows for increased heated process gas velocities and allows for decreased energy consumption.

Various embodiments of the invention will now be explained in greater detail. It is to be understood that both the foregoing general description and the following detailed description are exemplary and explanatory only, and are not restrictive of the invention as claimed. Any discussion of certain embodiments or features serves to illustrate certain exemplary aspects of the invention. The invention is not limited to the embodiments specifically discussed herein.

Unless otherwise indicated, all numbers such as those expressing temperatures, weight percent, concentrations, time periods, dimensions, and values for certain parameters used in the specification and claims are to be understood as being modified in all instances by the term "about," unless clearly stated otherwise. It should also be understood that the precise numerical values and ranges used in the specification and claims form additional embodiments of the invention.

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Accordingly, unless explicitly stated otherwise, the descriptions relate to one or more embodiments and should not be construed to limit the embodiments as a whole. This is true regardless of whether or not the disclosure states that a feature is related to "a," "the," "one," "one or more," "some," or "various" embodiments. Instead, the proper scope of the embodiments is defined by the appended claims. Further, stating that a feature may exist indicates that the feature may exist in one or more embodiments.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value and all values between, regardless as to if they have been explicitly identified. Similarly, when values are expressed as approximations, by use of the antecedent "about," it will be understood that the particular value forms another embodiment.

In this disclosure, the terms "include," "including," "comprise," "comprising," "contain," "containing," "have," and "having" when used after a set or a system, mean an open inclusion and do not exclude addition of other, non-enumerated, members to the set or to the system. Further, unless stated otherwise or deducted otherwise from the context, the conjunction "or," if used, is not exclusive, but is instead inclusive to mean and/or. Moreover, if these terms are used, a subset of a set may include one or more than one, up to and including all members of the set.

The phrase "consisting of" excludes any element, step or ingredient not specified in the claim. The phrase "consisting essentially of" limits the scope of a claim to the specified materials or steps and materials or steps that do not materially affect the basic and novel characteristics of the claimed invention. It is clear from this specification which elements do and do not materially affect the basic and novel characteristics of the claimed invention. Further, any elements recited in a dependent claim, even though further limiting, are not considered to be essential to the elements recited in the identified independent claim. The present disclosure contemplates embodiments of the invention compositions and methods corresponding to the scope of each of these phrases. Thus, a composition or method comprising recited elements or steps contemplates particular embodiments in which the composition or method consists essentially of or consists of those elements or steps.

Unless defined otherwise, all technical and scientific terms used herein have the same meaning as commonly understood by one of ordinary skill in the art to which this invention belongs. Although any methods and materials similar or equivalent to those described herein can be used in the practice or testing of the invention, the preferred methods and materials are now described.

Methods of use of the drier/bonder of the present invention are evident from the description herein and are specifically included as part of the disclosed invention.

Dryer Design

The design of the dryer of the present invention, with reduced diameter exhaust cylinders, provides several and varying benefits including better control of drying of the permeable or semi-permeable web owing to better control of air flow characteristics and adaptable physical geometry. The heated drying gas (130 in FIG. 1), after passing through the web and shell and perforated plate of the first foraminous cylinder, is directed axially for a distance to the exhaust head. This design allows for greater control of drying velocity at the edges of the web thereby permitting even drying over the width of the web. The used, moisture laden drying gas exits the exhaust cylinder (170 in FIG. 1).

Figure 2:
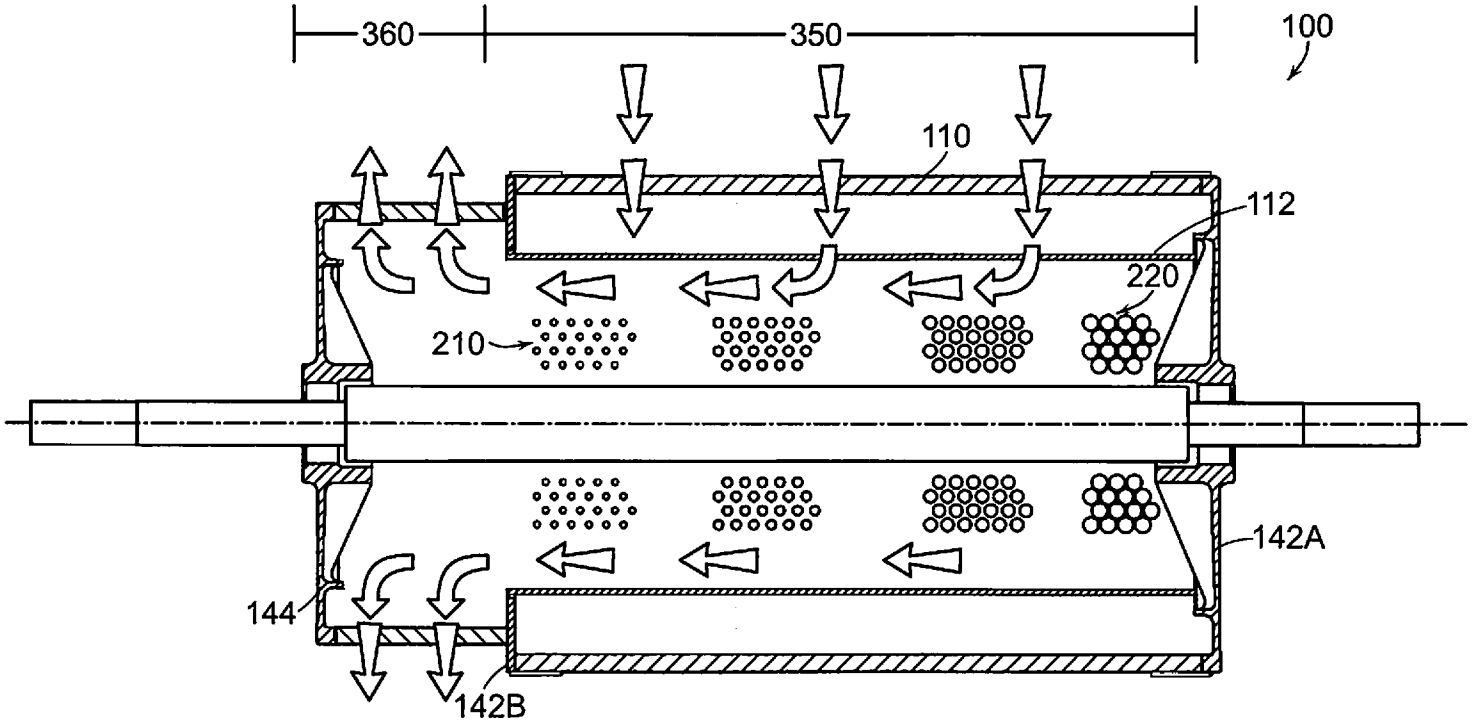
FIG. 2 shows a cross-sectional view of the foraminous shelled roll dryer of the present invention with reduced diameter exhaust. In this embodiment, the openings in the first foraminous cylinder vary in size with the openings having the greatest open area distal to the reduced diameter exhaust.

In this regard, FIGS. 1 and 2 show an embodiment of the present invention 100. The large arrows denote direction of drying gas (i.e., heated process air) flow 130. The foraminous shelled roll dryer comprises a first foraminous cylinder comprising a shell 110, and a perforated plate 112. The web to be dried rotates with the outer shell. The perforated plate is stationary and does not rotate with the shell. The perforated plate and stationary center pipe 120 are connected by the support bars 160 which make up the stationary baffle assembly. The shell is supported by first 142A and second 142B parallel, substantially parallel or essentially parallel end caps or roll heads with optional gusset plates 150. Drying air passes through the web (not shown), the shell and perforated plate. Openings 140 in the perforated plate may be evenly spaced or they may be clustered. The openings may be of the same or similar size. In one embodiment, the sizing and location of the openings aid in the control of air flow through the foraminous shell and the web being dried. Thus, for example, over drying of the edges of a web can be controlled and regulated by the number, size and placement of the openings in foraminous cylinder. See, for example, the sizing difference of the openings 210, 220 in FIG. 2. One of skill in the art, based on the teachings of this specification, will be able to determine opening sizes and locations for the web being dried, without undue experimentation.

Figure 3:
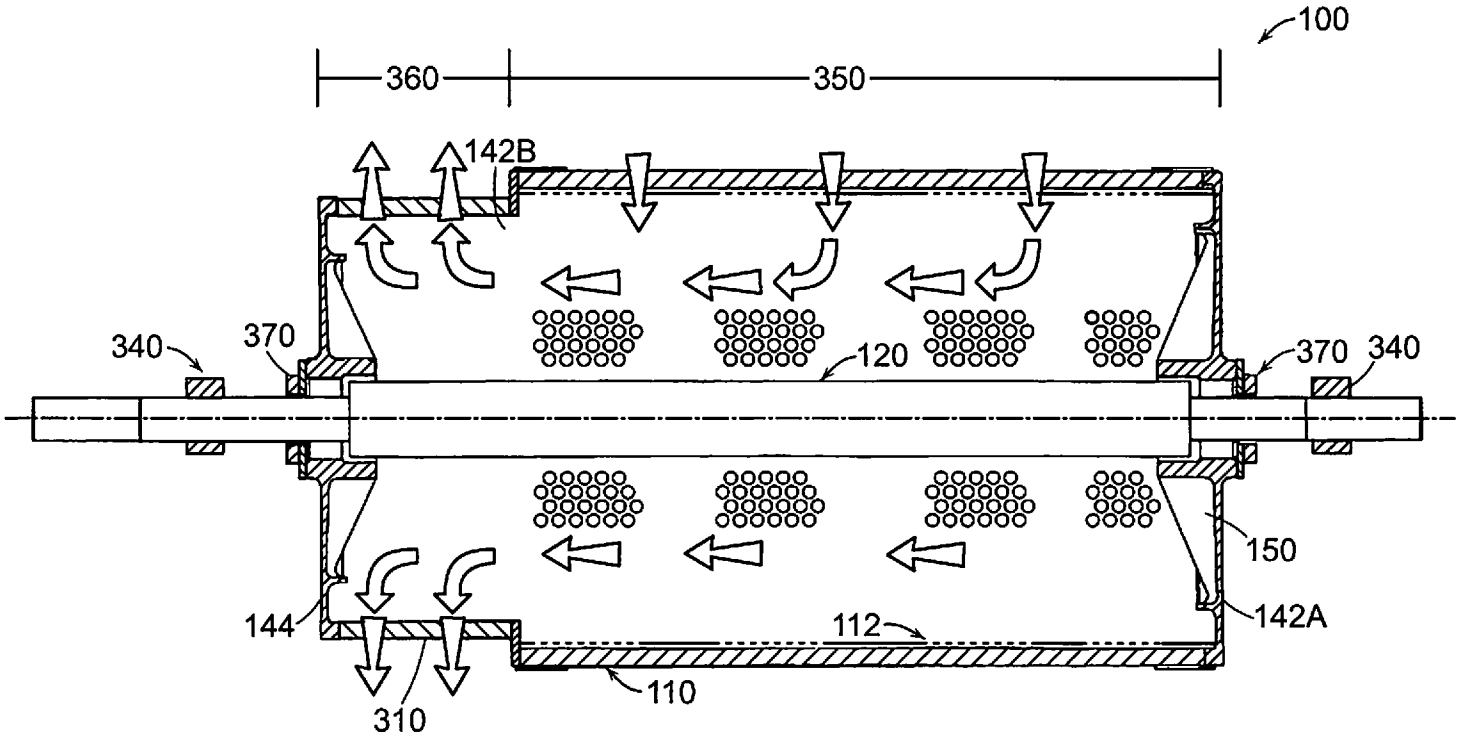
FIG. 3 shows an embodiment of the foraminous shelled roll dryer of the present invention with flange bearings and mounting blocks providing a rotating distribution means that incorporates a perforated plate that rotates with the shell.
Figure 4:
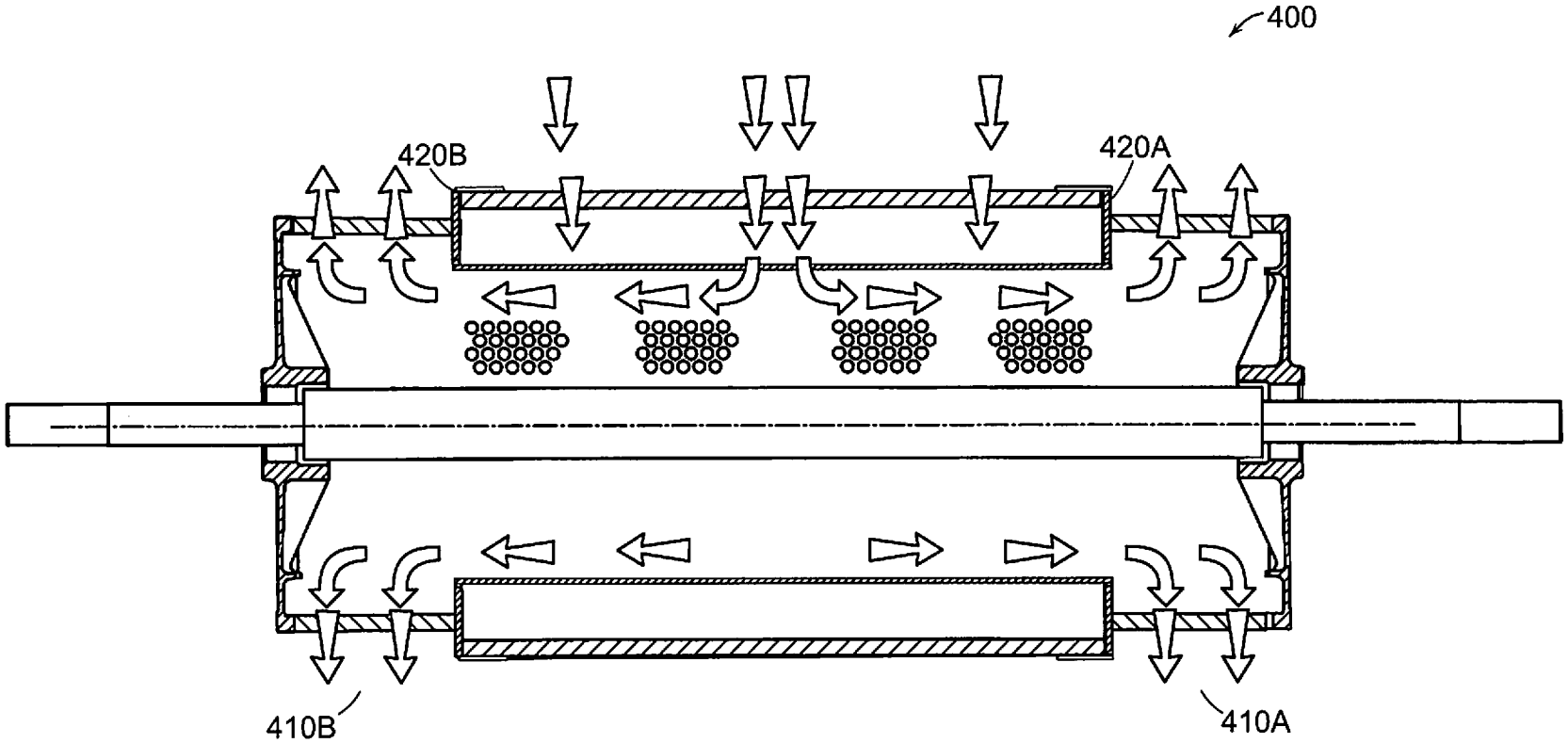
FIG. 4 shows an embodiment of the foraminous shelled roll dryer of the present invention with dual exhaust regions, one on each side of the first foraminous cylinder.

The drying gas (e.g., heated process air), after passing over the web and acquiring moisture from the web, exits the first foraminous cylinder axially into the exhaust area comprising a second (FIGS. 2 and 3, 360) and, optionally, a third foraminous cylinder as shown in FIG. 4 (also referred to as the first and second exhaust cylinders), where the moisture laden gas radially exits into duct work (not shown). The exhaust cylinder or cylinders are in fluid communication with the first foraminous cylinder shell. The exhaust cylinder or cylinders have a surface area from about 20% to about 75% of the surface area of the first foraminous cylinder or from about 30% to about 50% of the surface area of the first foraminous cylinder. Each of the one or two exhaust cylinders is at least 10% smaller in diameter than the first foraminous cylinder, at least 25% smaller in diameter than the first foraminous cylinder or at least 40% smaller in diameter than the first foraminous cylinder. The exhaust cylinder or cylinders are designed to handle the volume of drying gas necessary for efficient gas flow through the dryer. In this regard, the size, surface area and porosity of the exhaust cylinder or cylinders is calculated to be able to handle the required maximum volume of drying gas without hindering the drying of the web. The exhaust cylinder (or cylinders) has an end cap 144 that is parallel, substantially parallel or essentially parallel to the first 142A and second 142B end caps. As can be seen in the figures, the end cap between the first foraminous cylinder and second and/or third foraminous cylinders allows for fluid communication between the respective cylinders.

Continuing with the non-limiting embodiment of the present invention represented in FIGS. 2 and 3, the dryer with reduced diameter exhaust comprises a rotatable, first foraminous cylinder with a second foraminous cylinder with reduced diameter or, reduced diameter foraminous exhaust cylinder. The shell and perforated plate rotate about a stationary centerpipe. The dryer comprises a first and second spaced apart, circular, parallel end members, 142A and 142B, each having a diameter and an inner face and an outer face; a first foraminous cylinder 350 positioned between and secured to the first and second parallel end members, said first foraminous cylinder having an outer diameter substantially equivalent to the diameter of the parallel end members and having a surface area, said first foraminous cylinder designed for a flow of drying gas into the first foraminous cylinder. Also shown is the shell 110 of the first foraminous cylinder. A second foraminous cylinder 360 (i.e., the exhaust cylinder) of a smaller diameter than the first foraminous cylinder positioned at the outer face of the first parallel end member 142B and in fluid communication with the first foraminous cylinder, the second foraminous cylinder having an shell 310; the second foraminous cylinder having a surface area of about 20% to about 75% of the surface area of the first foraminous cylinder or having about 40% to about 60% of the surface area of the first foraminous cylinder or having about 30% to about 50% of the surface area of the first foraminous cylinder, said second foraminous cylinder designed for exhausting drying gas out of the first foraminous cylinder. The second foraminous cylinder is at least 10% smaller in diameter than the first foraminous cylinder, at least 25% smaller in diameter than the first foraminous cylinder or at least 40% smaller in diameter than the first foraminous cylinder. Thus, the configuration (i.e., ratio of axial length verses diameter) of the second foraminous cylinder may vary with regard to the spatial and other limitations so long as the surface area and diameter meet the aforementioned criteria. FIG. 3 also shows a pair of flange bearings 370 and mounting blocks 340. The dryer of FIG. 3 shows an embodiment of the foraminous shelled roll dryer of the present invention with flange bearings and mounting blocks that provide a rotating distribution means that incorporates a perforated plate 112 that rotates with the shell 110.

Looking now at FIG. 4, in a non-limiting embodiment of the present invention 400, the foraminous shelled roll dryer may have a third foraminous cylinder 410B of a smaller diameter than the first foraminous cylinder positioned at the outer face of the second parallel end member 420B and in fluid communication with the first foraminous cylinder, in addition to the second foraminous cylinder 410A positioned at the outer face of the first parallel end member 420A. In other words, the dryer may have a foraminous exhaust cylinder at each end of the first foraminous cylinder. In this situation, it is contemplated that each of the exhaust capacity of the two exhaust cylinders combine is substantially equal to the exhaust capacity of a similar or identical dryer with a single exhaust cylinder. In other words, the combined surface area of the second and third foraminous cylinders having a surface area of about 20% to about 75% of the surface area of the first foraminous cylinder or having about 40% to about 60% of the surface area of the first foraminous cylinder or having about 30% to about 50% of the surface area of the first foraminous cylinder. Each of the second foraminous cylinder and the third foraminous cylinder is at least 10% smaller in diameter than the first foraminous cylinder, at least 25% smaller in diameter than the first foraminous cylinder or at least 40% smaller in diameter than the first foraminous cylinder. Thus, the configuration (i.e., ratio of axial length verses diameter) of each of the second and third foraminous cylinders may vary with regard to the spatial and other limitations so long as the surface area and diameter meet the aforementioned criteria. Further, the configuration of the second and third foraminous cylinders may be the same or different as needed.

Figure 5:
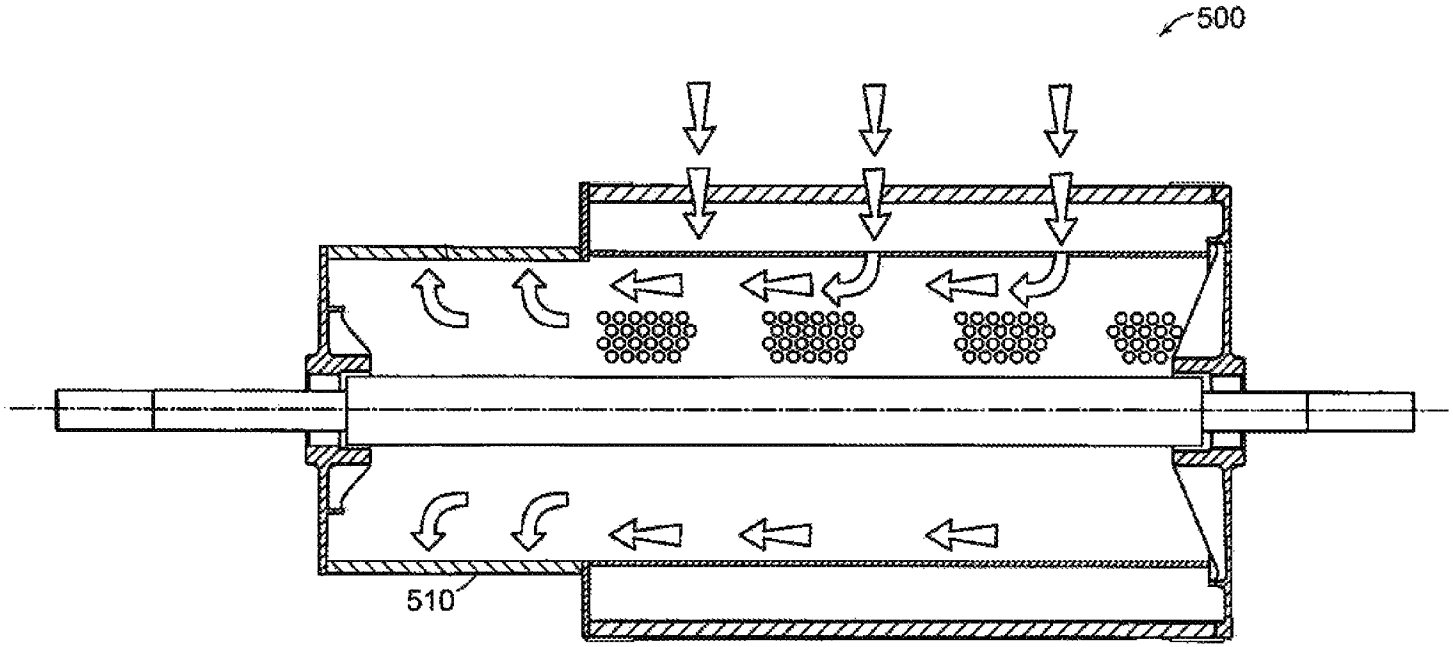
FIG. 5 shows an embodiment of the foraminous shelled roll dryer of the present invention with an extended reduced diameter exhaust.

Looking now at FIG. 5, in a non-limiting embodiment of the present invention 500, the exhaust cylinder (i.e., second foraminous cylinder) 510 of the dryer may be narrower and longer to fit into a required space. Modification of the diameter and length of the exhaust cylinder(s) is contemplated by the present invention so long as the exhaust capacity is sufficient for operation of the dryer as described herein.

Figure 6:
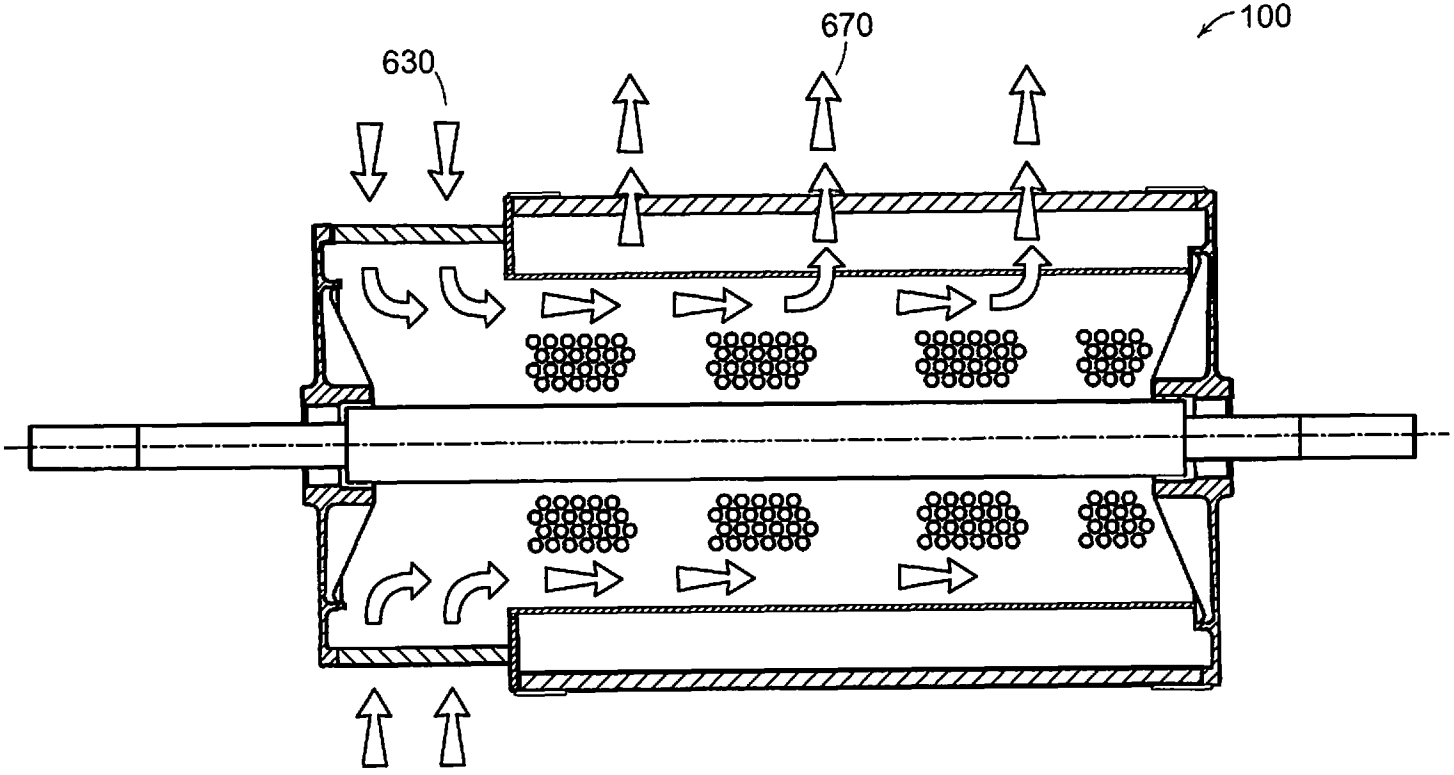
FIG. 6 shows an embodiment of the foraminous shelled roll dryer of the present invention wherein the air flow is reversed.

Looking now at FIG. 6, in a non-limiting embodiment of the present invention, the gas flow 630 of the device may be reversed such that it enters through the outer shell of the second foraminous cylinder and exits through the outer shell of the first foraminous cylinder 670. Reversing drying gas flow may be required in certain drying situations.

Figure 7:
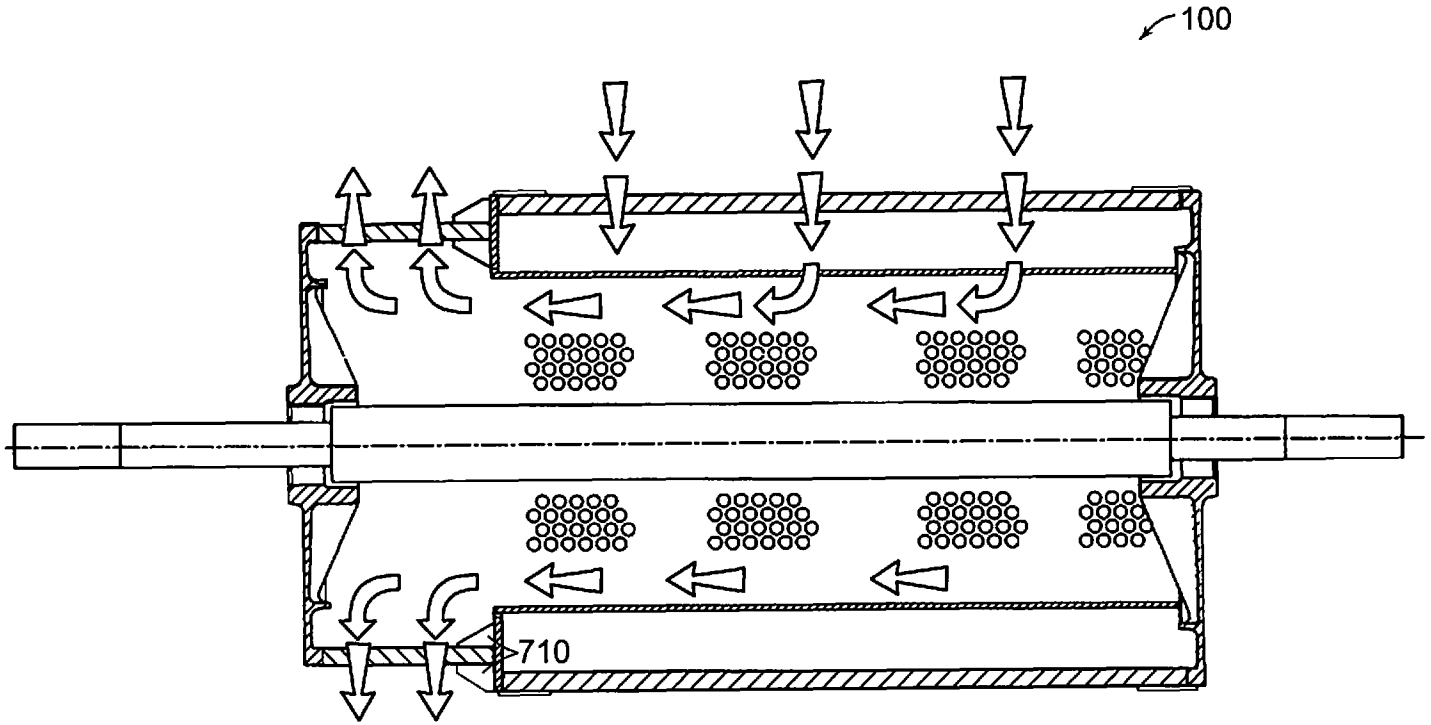
FIG. 7 shows an embodiment of the foraminous shelled roll dryer of the present invention with support gussets in the exhaust shell.

Looking now at FIG. 7, in a non-limiting embodiment of the present invention, the exhaust cylinder has additional support in the form of gussets 710 located, for example, between the exhaust cylinder and the parallel end member of the first foraminous cylinder. Said gussets efficiently reinforce the junction between the exhaust cylinder and foraminous shelled cylinder.

Figure 8:
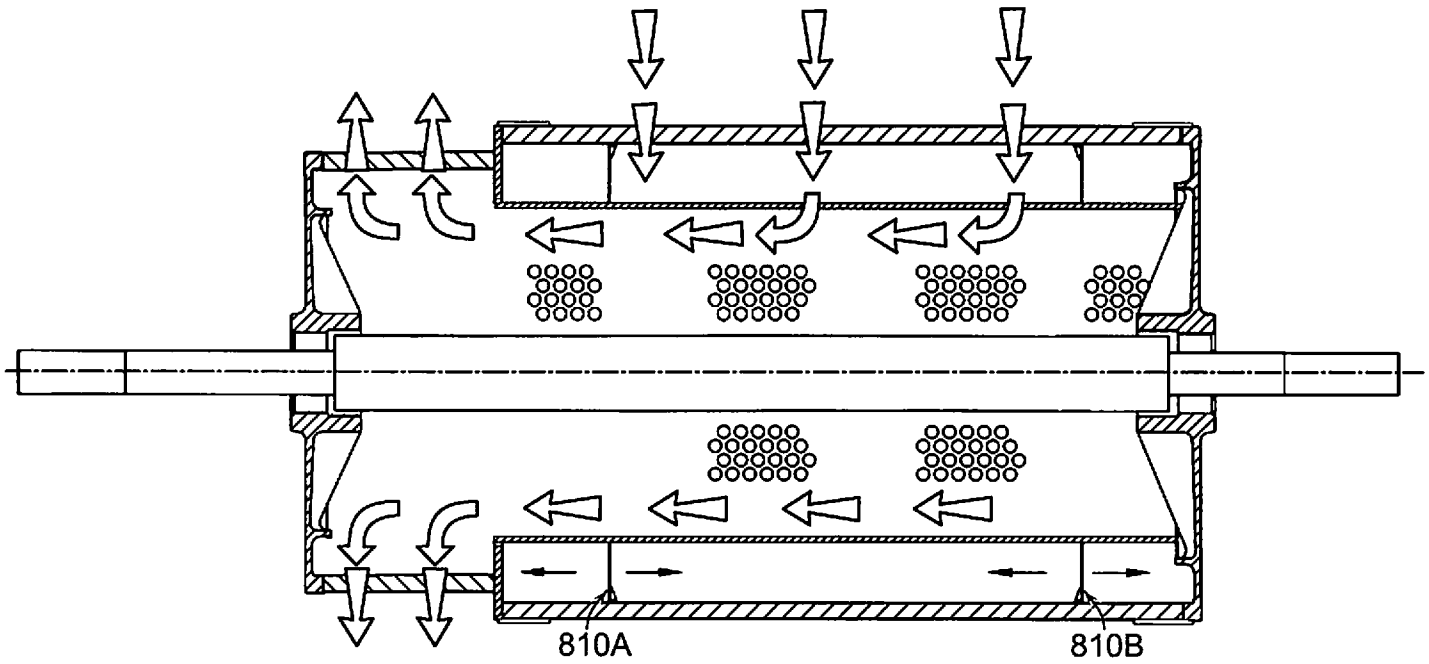
FIG. 8 shows an embodiment of the foraminous shelled roll dryer of the present invention with adjustable deckle seals.
Figure 9A:
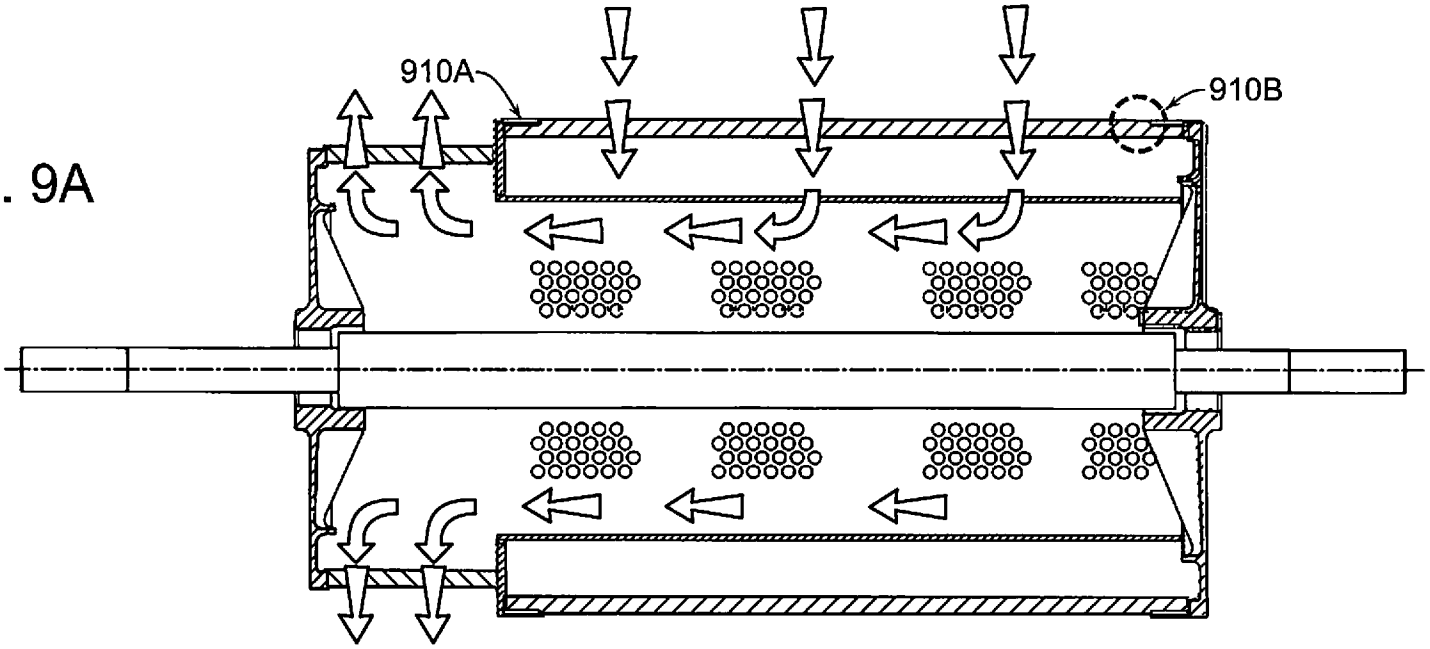
FIGS. 9 A & B show an embodiment of the foraminous shelled roll dryer of the present invention wherein the deckle bands are recessed. 9B shows a close-up view of the recessed deckle band.
Figure 9B:
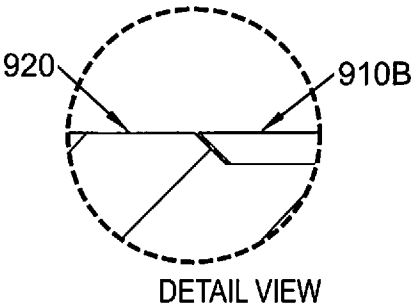
Figure 10:
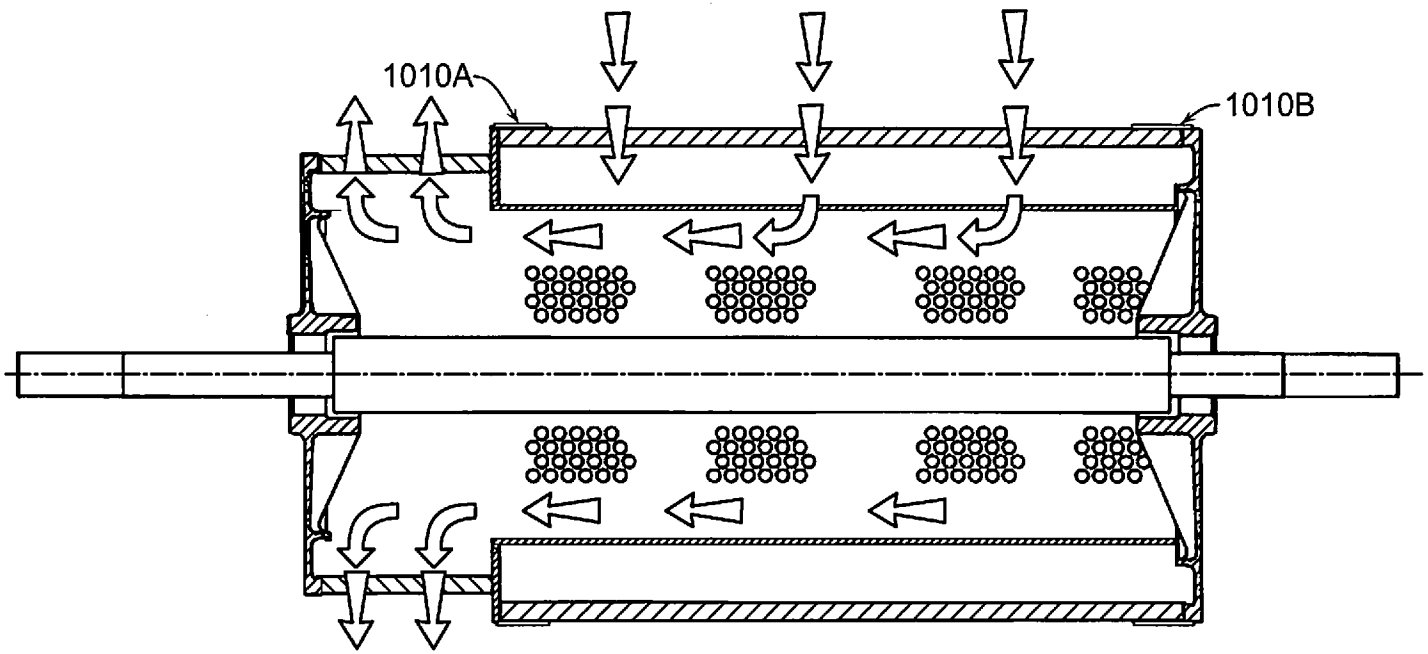
FIG. 10 shows an embodiment of the foraminous shelled roll dryer of the present invention wherein the deckle bands are exterior to the shell.

The dryer of the present invention is designed to be flexible with regard to the types, sizes and weights of permeable and semi-permeable webs that can be dried. In this regard, the dryer of the present invention contemplates the incorporation of deckle bands in some embodiments. Deckle bands are known to those of ordinary skill in the art to be bands around the edge of a machine roll or cylinder for drying permeable and semi-permeable webs that determine the active width of the cylinder typically corresponding to the width of the web. Deckle bands are thin, solid strips of material that align along one edge with an end member and wrap around the entire circumference of a cylinder, but extend across only a small portion of the cylinder width. The inboard edge of a deckle band therefore defines the sheet width to be processed by the cylinder. Examples of dryers known in the art are described, for example, by U.S. Pat. Nos. 3,259,961, 3,590,453, and 4,050,131, which are incorporated herein by reference. Deckle bands are also helpful in preventing or limiting over-drying or under-drying of the edges of the web. FIG. 8 shows adjustable deckle shields 810A and 810B that are located in the foraminous shelled cylinder. FIGS. 9A & B show recessed deckle bands 910A and 910B located on the outer edges of the first foraminous shelled cylinder 920. FIG. 10 shows traditional, non-recessed deckle bands 1010A and 1010B.

Figure 11:
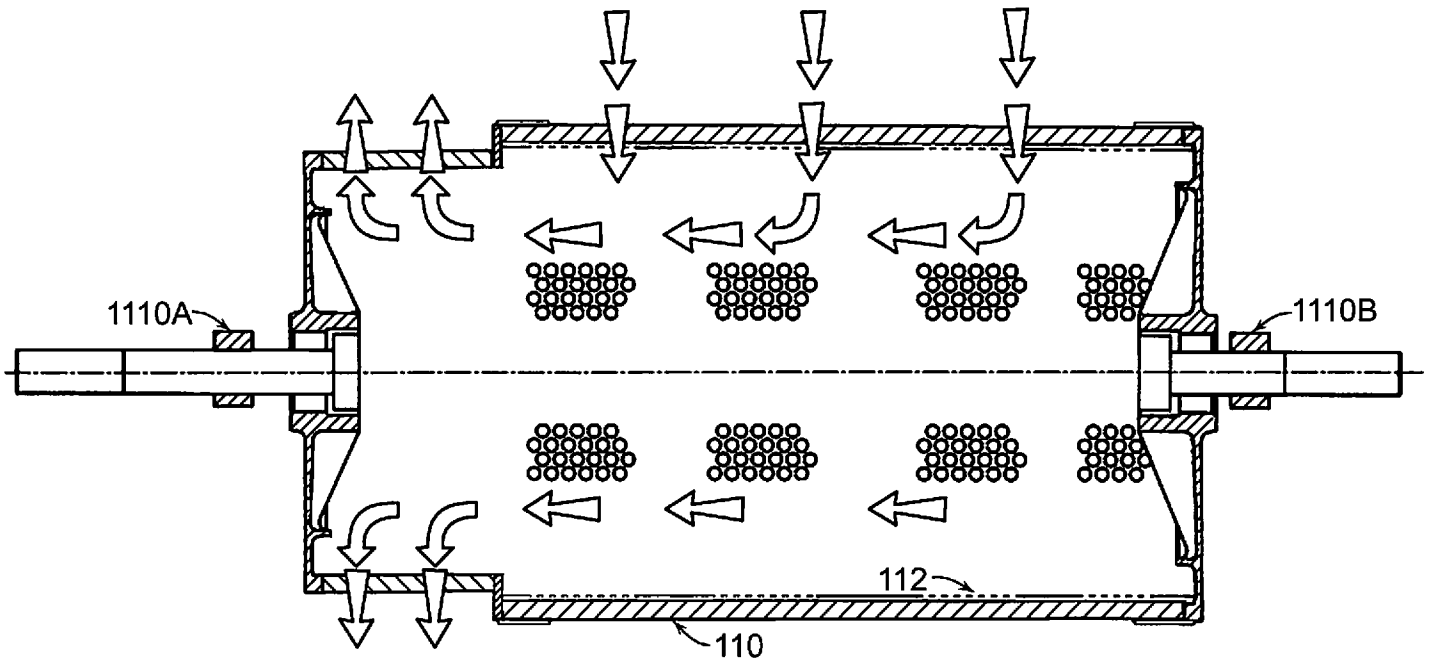
FIG. 11 shows an embodiment of the present invention without the use of a centerpipe providing a rotating distribution means that incorporates a perforated plate that rotates with the shell.

FIG. 11 shows an embodiment of the present invention with a rotating perforated plate without a center pipe. Mounting blocks are shown at 1110A and 1110B.

Figure 12:
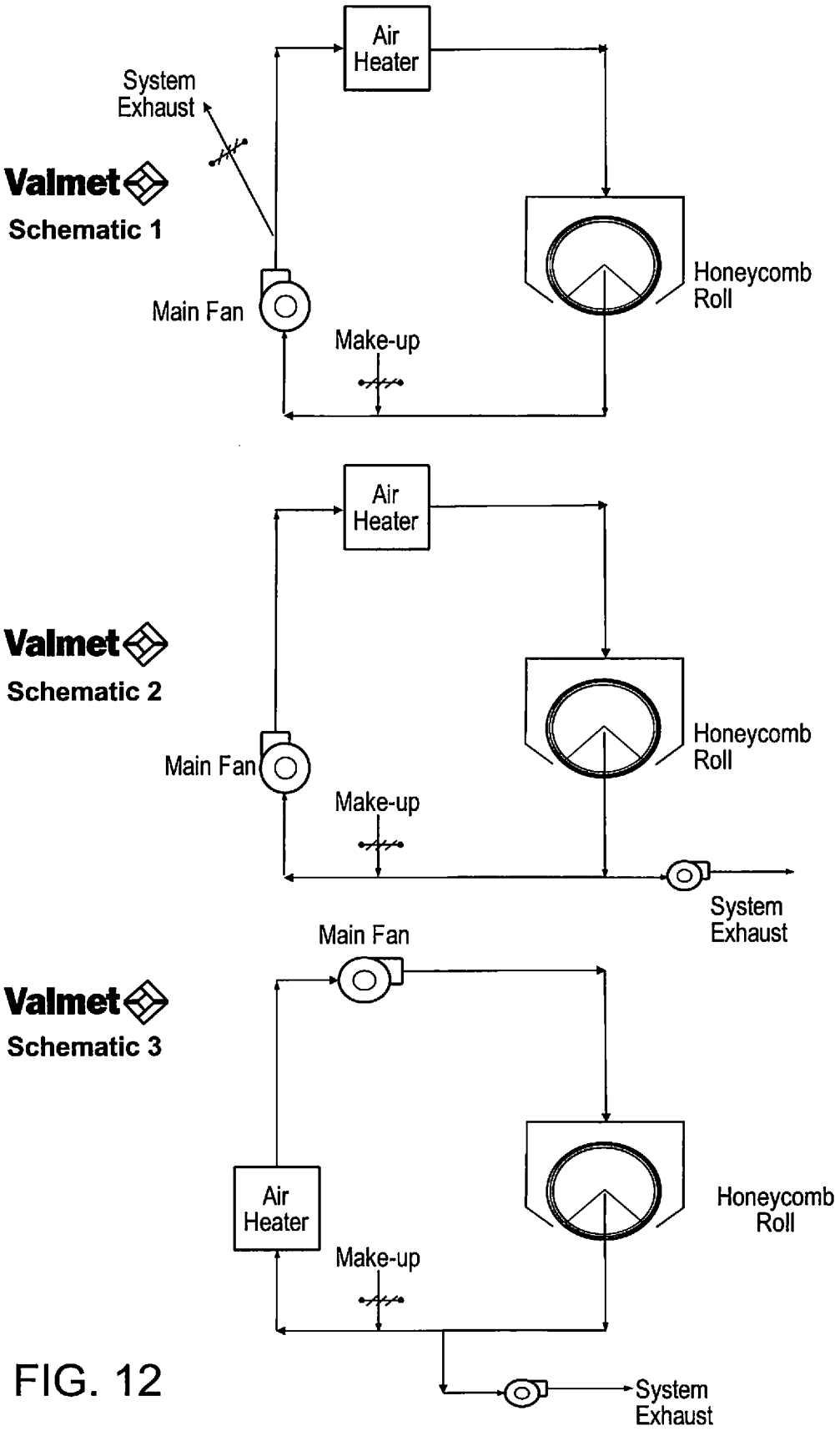
FIG. 12 shows three schematic diagrams with three different air handling pathways that are suitable for use with the present invention.

FIG. 12 shows three schematics that represent non-limiting embodiments for the flow of drying gas in the device and methods of the present invention. Schematic 1 shows heated drying gas from the air heater being directed through the dryer of the present invention. Exhaust drying gas has, as needed, make-up air added. One or more fans, here represented by the indication of a main fan, move the drying gas through the system. A portion of the spent drying gas is exhausted from the system to regulate the mass balance of the system. The remaining drying gas is directed to the air heater.

Schematic 2 and schematic 3 are further variations on the design show in schematic 1.

With regard to drying webs comprising, for example, of paper and paper by-products, the drying gas (e.g., heated process air) passed through a wet sheet of permeable or semi-permeable web of woven and/or non-woven fibers traveling on the rotating foraminous shell of the first foraminous cylinder with or without a fabric layer therebetween. Heated process air may be, for example, about 120 to about 290 degrees Celsius. The heated process air travels through the wet sheet, picks up moisture from the sheet and exits the shell at an exhaust temperature of, for example, about 80 to about 260 degrees Celsius. Through evaporation of the moisture in the wet sheet the heated process air is cooled. It is this cooled process air that exits the exhaust cylinder. Some amount of the cooled process air from 0% and up to 100% is exited from the flow stream. Any remaining cooled process air including makeup air introduced as fresh air, combustion air or parasitic leak is recirculated through the dryer and reheated. The temperature and air flow requirements are determined by the required evaporation from the web being dried and the speed of the rotating first foraminous shelled cylinder. The US Patents referenced herein show that one of ordinary skill in the art can determine the correct process parameters.

It is noted that the foregoing description and examples have been provided merely for the purpose of explanation and are in no way to be construed as limiting of the present invention. While the present invention has been described with reference to an exemplary embodiment, it is understood that the words, which have been used herein, are words of description and illustration rather than words of limitation. Changes may be made, within the purview of the appended claims, as presently stated and amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims and skill of one of ordinary skill in the art to which the invention pertains.

In some embodiments of the present invention a "cool zone" is incorporated in the dryer/bonder of the present invention. The cool zone is an area of the shelled foraminous cylinder that runs the length of the cylinder, substantially the length of the cylinder or essentially the length of the cylinder at a position where the web being dried leaves the cylinder or just before the position where the web being dried leaves the cylinder (i.e., proximal to where the web being dried leaves the cylinder). A cool zone is used to lower the temperature of the web prior to leaving the drying cylinder. Cooling the web serves to reduce the likelihood of the web sticking to the wire, cool the product before it is wound on the reel and/or to solidify bond junctions in the web. The "cool zone" channels drying gas separately from the main drying gas. The cooling gas may be at least 100° C. lower than the temperature of the drying gas. The temperature of the cooling gas is approximately 4° C. to approximately 32° C. but can be cooler or hotter so long as it is effective in cooling the web as it exits the drying cylinder. The temperature of the cooling gas may be ambient temperature. The second and, if present, the third foraminous cylinders may also have a "cool zone" for the purpose of exhausting the cooling gas from the dryer.

Figure 13B:
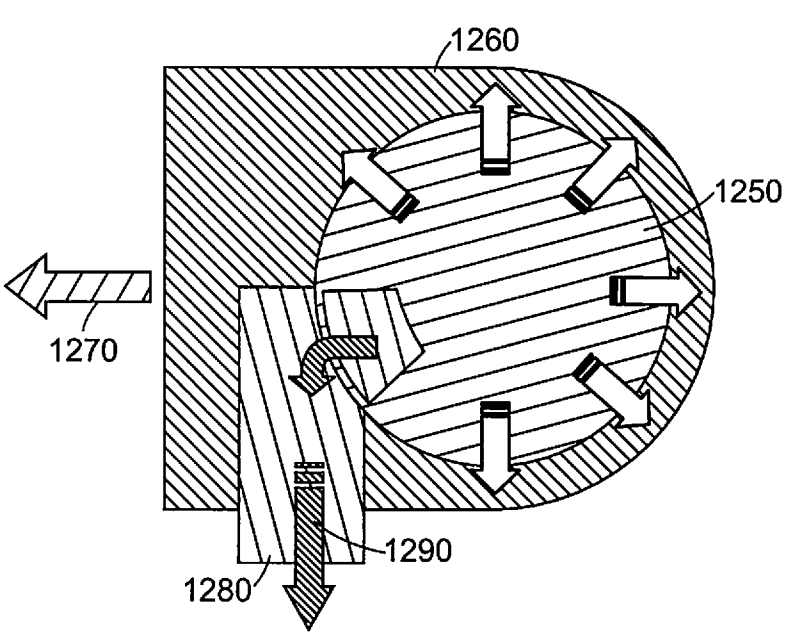
FIGS. 13 A & B show an embodiment of the optional cool zone of the present invention. 13A shows the through air dryer or bonder with cool zone. 13B shows the exhaust cylinder and exhaust duct with a cool zone.
Figure 13A:
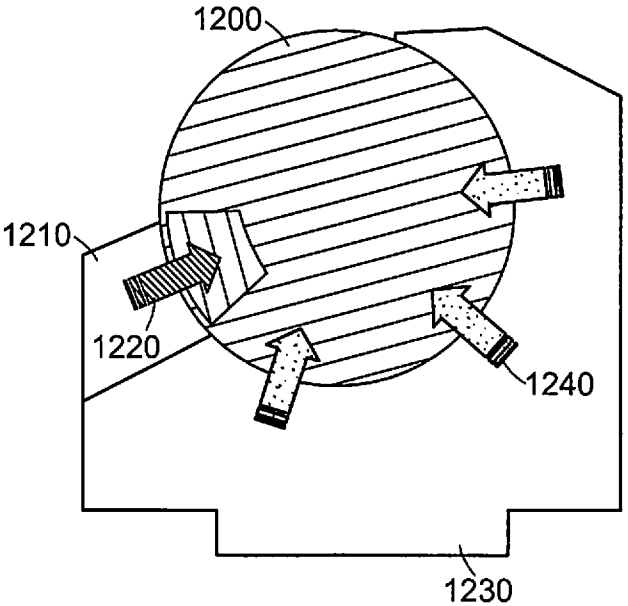

The cool zone works by having cooling gas or cooling air pass through the web. The cooling gas is then exited through the exhaust cylinder(s) of the present invention. FIG. 13 shows an embodiment of the cool zone of the present invention. FIG. 13A shows a cross-section of the through air dryer 1200 with cool zone 1210 with air flow direction 1220 indicated. Also shown are the drying hood 1230 with drying gas flow direction indicated 1240. FIG. 13B shows a cross-section of the through air dryer exhaust 1250, and exhaust duct work 1260 with heated gas exhaust direction indicated 1270. FIG. 13B also shows the cool zone exhaust 1280 with cool zone exhaust direction indicated 1290.

We claim:

1. A rotatable, foraminous shelled roll dryer, for drying permeable and semi-permeable webs, with reduced diameter exhaust shell, comprising:

a. a first and second spaced apart, circular, parallel end members, each having a diameter and an inner face and an outer face;

b. a first foraminous cylinder positioned between and secured to the first and second parallel end members, the first foraminous cylinder having an outer diameter substantially equivalent to the diameter of the parallel end members and having a surface area, the first foraminous cylinder designed for a flow of drying gas into the first foraminous cylinder; and c. a second foraminous cylinder of a smaller diameter than the first foraminous cylinder positioned at the outer face of the first parallel end member and in fluid communication with the first foraminous cylinder, the second foraminous cylinder having a surface area of about 20% to about 75% of the surface area of the first foraminous cylinder, the second foraminous cylinder designed for exhausting drying gas out of the first foraminous cylinder.

2. The foraminous shelled roll dryer of claim 1, wherein the surface area of the second foraminous cylinder is about 30% to about 50% the surface area of the first foraminous cylinder.

3. The foraminous shelled roll dryer of claim 1, wherein the diameter of the second foraminous cylinder is at least 10% less than the diameter of the first foraminous cylinder.

4. The foraminous shelled roll dryer of claim 1, wherein the diameter of the second foraminous cylinder is at least 25% less than the diameter of the first foraminous cylinder.

5. The foraminous shelled roll dryer of claim 1, wherein the diameter of the second foraminous cylinder is at least 10% less but no more than 40% less than the diameter of the first foraminous cylinder.

6. The foraminous shelled roll dryer of claim 1, wherein the second foraminous cylinder has a circular parallel end member positioned at the end of the second foraminous cylinder positioned opposite to the first parallel end member and parallel to the first parallel end member.

7. The foraminous shelled roll dryer of claim 1, further comprising a third foraminous cylinder of a smaller diameter than the first foraminous cylinder positioned at the outer face of the second parallel end member and in fluid communication with the first foraminous cylinder, the second and third foraminous cylinders having a combined surface area of about 20% to about 75% of the surface area of the first foraminous cylinder, the third foraminous cylinder designed for exhausting drying gas out of the first foraminous cylinder.

8. The foraminous shelled roll dryer of claim 7, wherein the combined surface area of the second and third foraminous cylinders is about 30% to about 50% the surface area of the first foraminous cylinder.

9. The foraminous shelled roll dryer of claim 7, wherein the diameter of the third foraminous cylinder is at least 10% less than the diameter of the first foraminous cylinder.

10. The foraminous shelled roll dryer of claim 7, wherein the diameter of the third foraminous cylinder is at least 25% less than the diameter of the first foraminous cylinder.

11. The foraminous shelled roll dryer of claim 7, wherein the third foraminous cylinder has a circular parallel end member positioned at the end of the third foraminous cylinder positioned opposite to the second parallel member and parallel to the second parallel member.

12. The foraminous shelled roll dryer of claim 7, wherein the diameter of the third foraminous cylinder is at least 10% less but no more than 40% less than the diameter of the first foraminous cylinder.

13. The foraminous shelled roll dryer of claim 1, the dryer further comprising an area substantially the length of the first foraminous cylinder designed for the delivery of cooling gas separately from the delivery of the drying gas, the cooling gas at a temperature approximately 4° C. to approximately 32° C., wherein the area designed for the delivery of a cooling gas is located at or proximal to where the web being dried leaves the first foraminous cylinder.

14. The foraminous shelled roll dryer of claim 13, the second foraminous cylinder further comprising an area substantially the length of the second foraminous cylinder designed for the exhausting of cooling gas separately from the exhausting of the drying gas.

* * * * *